US006975342B2

(12) United States Patent
Dougherty

(10) Patent No.: US 6,975,342 B2
(45) Date of Patent: Dec. 13, 2005

(54) PRINT CARTRIDGE

(75) Inventor: Patrick S. Dougherty, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 91 days.

(21) Appl. No.: 10/274,096

(22) Filed: Oct. 17, 2002

(65) Prior Publication Data

US 2004/0075732 A1 Apr. 22, 2004

(51) Int. Cl.[7] ..... G01D 15/16; G03G 15/08
(52) U.S. Cl. ..... 347/214
(58) Field of Search ..... 399/150, 98, 102, 399/103, 106; 347/214, 112, 86

(56) References Cited

U.S. PATENT DOCUMENTS 5,258,814 A 11/1993 Davies
5,274,425 A 12/1993 Fukumoto et al.
5,678,143 A * 10/1997 Nagahara et al. ..... 399/150
5,794,101 A 8/1998 Watanabe et al.
5,809,374 A 9/1998 Tsuda et al.
5,839,027 A 11/1998 Sahay et al.
5,852,462 A 12/1998 Lloyd et al.
5,865,121 A 2/1999 Testardi et al.
6,014,534 A 1/2000 Goebel et al.
6,070,027 A * 5/2000 Kawai et al. ..... 399/103
6,160,073 A 12/2000 Dowlen et al.
6,184,914 B1 2/2001 Hoberock et al.
6,560,422 B2 * 5/2003 Kanno et al. ..... 399/106
6,640,066 B2 * 10/2003 Sato ..... 399/106
6,643,481 B2 * 11/2003 Higeta et al. ..... 399/109

* cited by examiner

*Primary Examiner*—K. Feggins

(57) ABSTRACT

A print cartridge according to a particular embodiment of the invention includes a housing and a seal disposed within the housing. The seal includes a longitudinal section having a first end and a second end, a first lateral section connected to and extending from the first end of the longitudinal section, and a second lateral section connected to and extending from the second end of the longitudinal section. The longitudinal section, the first lateral section, and the second lateral section are arranged to be generally continuous and to generally prevent toner leakage from the print cartridge.

29 Claims, 7 Drawing Sheets

PRINT CARTRIDGE

BACKGROUND OF THE INVENTION

An electro-photographic printer operates by exposing a charged photoconductive drum to selective light patterns to define an electrostatic image on the photoconductive drum. A plurality of toner particles are released from a print cartridge and applied to the photoconductive drum via a developer roller. The toner particles applied to the areas of the photoconductive drum defining the electrostatic image are transferred to a print media, such as paper, cardstock, transparencies, Mylar, cloth, and the like. The print media holding the loose toner particles is passed between a heated fuser roller and a pressure roller to fuse the toner particles to the media, thereby producing a final printed document.

The print cartridge contains a supply of toner in a toner supply chamber. The toner supply chamber is located within the print cartridge such that toner can flow from the toner supply chamber to the developer roller by gravity. Due to the fluid and staining properties of the toner, measures are taken to decrease leakage of excess toner from the print cartridge to unwanted areas. A conventional printer helps control toner dispersal and, thereby, decreases toner leakage by utilizing an assembly of seals within the print cartridge.

A conventional print cartridge, such as the print cartridge generally illustrated at 10 in FIGS. 1 and 2, includes a housing 12, a supply roller 14, a developer end seal 16, a developer end seal 18, a blow-out seal 20, a doctor blade 22, and a developer roller 23 (shown in FIG. 2; not shown in FIG. 1 for clarity). Housing 12 defines a toner supply chamber (not shown) and a dispersion cavity 24. Supply roller 14 extends longitudinally within housing 12, more particularly within the toner supply chamber. Supply roller 14 is flanked on each end by a first support 26 and a second support 28. As such, first and second supports 26 and 28 define an interface area (not shown), which designates the line of contact between supply roller 14 and developer roller 23. With respect to the orientation of FIG. 1 and FIG. 2, a top edge of each support 26 and 28 is covered with developer end seal 16 and developer end seal 18, respectively. Each developer end seal 16 and 18 extends to a front edge 32 of dispersion cavity 24 to interact with blow-out seal 20, which extends along the longitudinal length of front edge 32 of dispersion cavity 24. Doctor blade 22 extends between developer end seal 16 and developer end seal 18 in an orientation substantially parallel to blow-out seal 20. Doctor blade 22 interacts with developer end seal 16 and developer end seal 18 opposite blow-out seal 20. Developer roller 23 extends over and between first and second supports 26 and 28 and, thereby, over developer end seals 16 and 18, partially resting upon developer end seals 16 and 18 and supply roller 14.

During use, print cartridge 10 is oriented such that the toner supply chamber is located above the developer roller 23. Rotation of developer roller 23 induces reciprocal rotation of supply roller 14. The interaction and rotation between developer roller 23 and supply roller 14 causes the toner to be transferred from supply roller 14, located within the toner supply chamber, to developer roller 23. As such, developer end seals 16 and 18 are adapted to decrease leakage of toner at either end of the interface area (not shown). Furthermore, blow-out seal 20 is adapted to decrease leakage of toner out front edge 32 of dispersion cavity 24.

Developer end seals 16 and 18 are generally effective in decreasing toner leakage beyond the ends of interface area (not shown), and blow-out seal 20 is generally effective in decreasing toner leakage out front edge 32 of dispersion cavity 24. However, the interface between each developer end seal 16 or 18 and blow-out seal 20 provides a path for toner to leak or escape from the interface area. Escape of toner from the interface area may allow toner to seep into unwanted areas of the printer and, therefore, may become a detriment to the print quality of the end document. Furthermore, toner leakage may cause a user to get toner on himself or herself or clothing, which may be difficult to clean or remove.

SUMMARY OF THE INVENTION

A print cartridge according to a particular embodiment of the invention includes a housing and a seal disposed within the housing. The seal includes a longitudinal section having a first end and a second end, a first lateral section connected to and extending from the first end of the longitudinal section, and a second lateral section connected to and extending from the second end of the longitudinal section. The longitudinal section, the first lateral section, and the second lateral section are arranged to be generally continuous and to generally prevent toner leakage from the print cartridge.

BRIEF DESCRIPTION OF THE DRAWINGS

The accompanying drawings illustrate embodiments of the present invention and together with the description serve to explain certain principles of the invention. Other embodiments of the present invention will be readily appreciated with reference to the drawings and the description, in which like reference numerals designate like parts and in which.

DETAILED DESCRIPTION OF THE PREFERRED EMBODIMENTS

In the following detailed description of preferred embodiments, reference is made to the accompanying drawings, which form a part hereof, and in which are shown by way of illustration specific embodiments in which the invention optionally is practiced. Directional terminology, such as "top," "bottom," "rear," "front," "below," etc., is used for purposes of illustration and with reference to the orientation of the Figure(s) being described. However, the embodiments described herein optionally are positioned in a number of different orientations such that the directional terminology is in no way limiting. It is to be understood that other embodiments optionally are utilized and structural or logical changes optionally are made without departing from the scope of the present invention.

Figure 1:
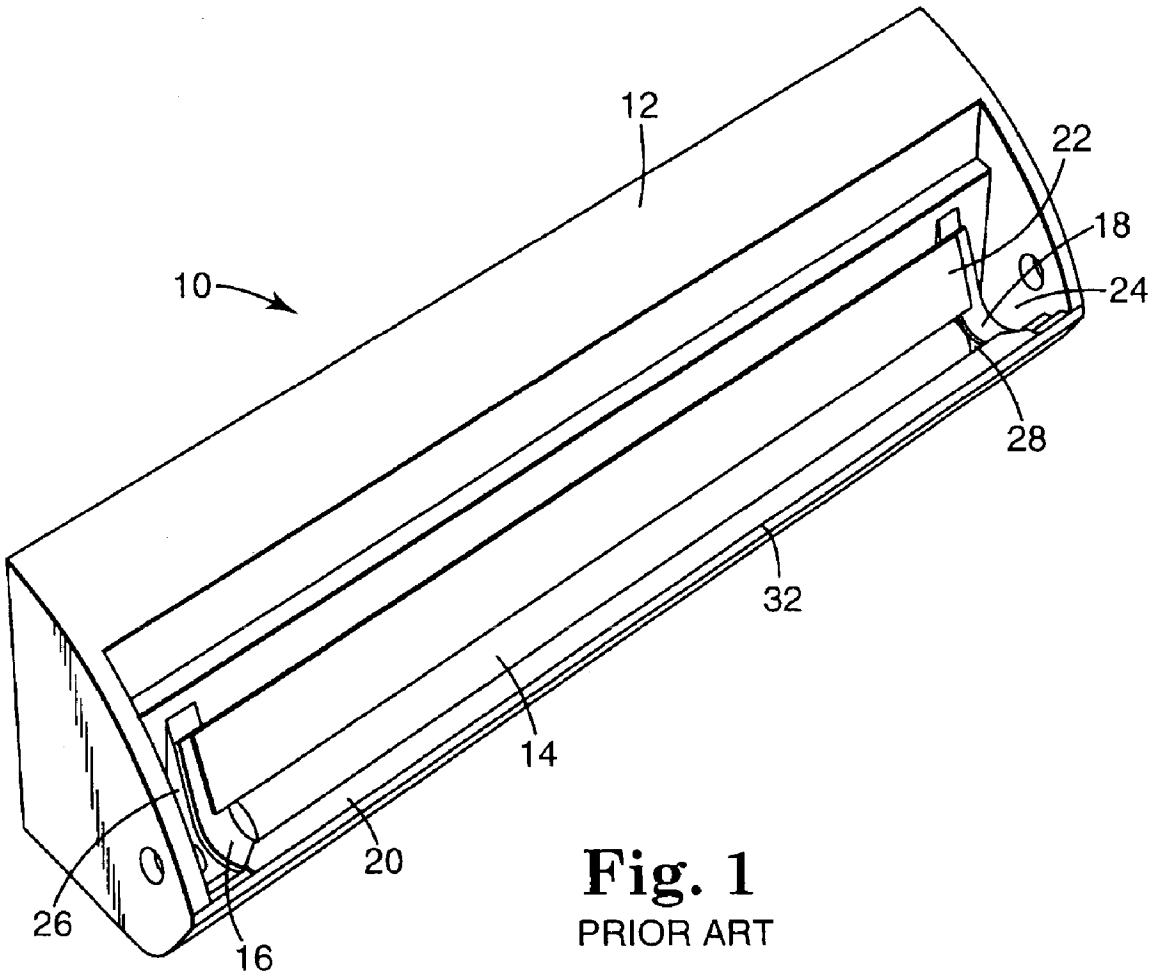
Fig. 1 PRIOR ART
FIG. 1 is a perspective view illustrating a portion of a conventional print cartridge.
Figure 2:
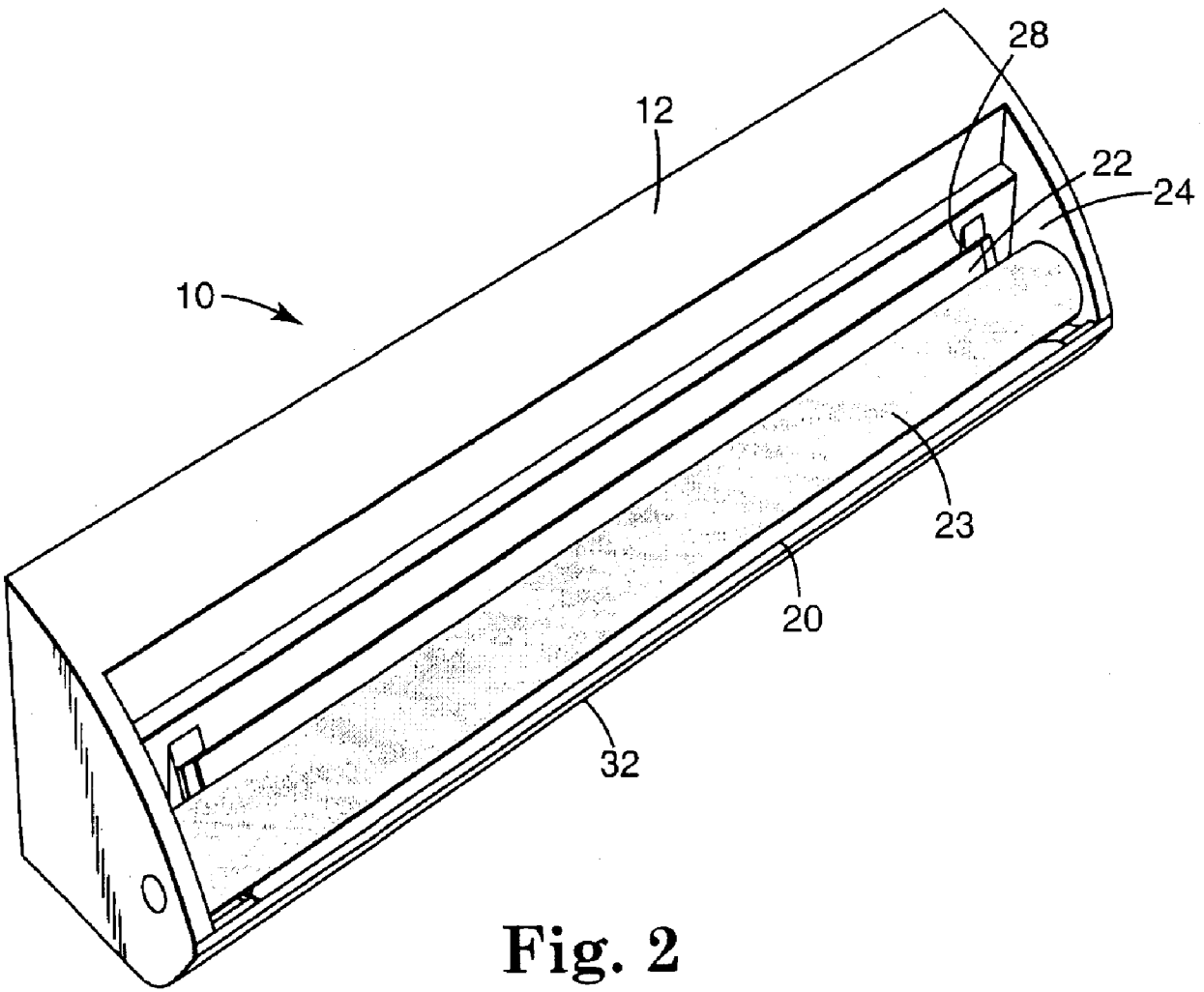
Fig. 2 PRIOR ART
FIG. 2 is a perspective view illustrating the portion of a conventional print cartridge illustrated in FIG. 1 including a developer roller.
Figure 3:
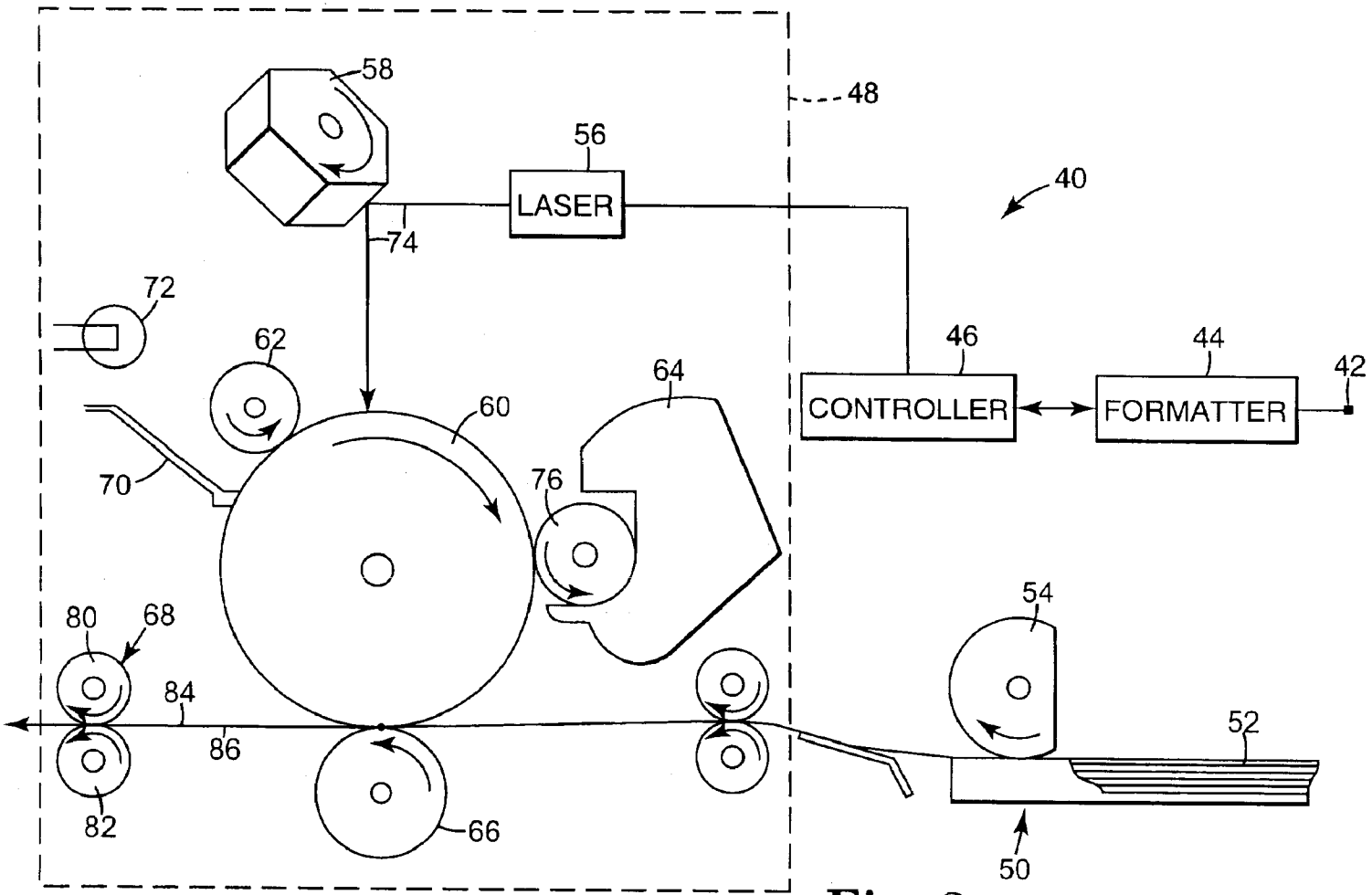
FIG. 3 is a schematic view illustrating a printer according to an embodiment of the invention.

FIG. 3 is a schematic illustration of one embodiment of a printer 40. Printer 40 generally includes an input port 42, a formatter 44, a controller 46, a print engine 48, and a print media tray 50. A computer processing unit or other image generating device (not shown) transmits image data to input port 42. The image data is sent from input port 42 to formatter 44. Formatter 44 generates an electronic representation of the image to be printed, temporarily stores the electronic representation, and forwards the electronic representation to controller 46.

Controller 46 manages the operations of print engine 48 and print media tray 50. Controller 46 sends instructions to print engine 48 based on the electronic representation to effectuate printing of the image. Controller 46 also manages the print media tray 50, which stores a print medium 52, such as paper, cloth, cardstock, Mylar, and the like, and includes a feed roller 54. Print medium 52 is fed into print engine 48 by feed roller 54 as dictated by controller 46. Print engine 48 converts data from controller 46 into a printed image or character(s) upon print medium 52 and outputs printed print medium 52 to a user (not shown).

Print engine 48 includes a laser 56, a multi-faceted spinning mirror 58, a photoconductive drum 60, a charging roller 62, a print cartridge 64, a transfer roller 66, a fuser 68, a cleaning blade 70, and a discharge lamp 72. Controller 46 communicates with laser 56 to generate a laser beam 74 that corresponds with the electronic representation received from formatter 44. Laser beam 74 is directed towards and reflected off multi-faceted spinning mirror 58 towards photoconductive drum 60 with varying intensity and duration as dictated by controller 46. Controller 46 also manages the spinning of multi-faceted spinning mirror 58 to reflect laser beam 74 towards photoconductive drum 60 in a desired pattern or sequence.

Notably, prior to interaction with laser beam 74, photoconductive drum 60 is rotated past charging roller 62. Charging roller 62 introduces a relatively high and substantially uniform polarity to the surface of photoconductive drum 60. Upon interaction with laser beam 74, uniformly charged photoconductive drum 60 becomes partially or fully discharged, depending upon the intensity and duration of laser beam 74 upon photoconductive drum 60. Areas of photoconductive drum 60 not contacted by laser beam 74 remain fully charged. The selective discharging of photoconductive drum 60 by laser beam 74 creates a latent electrostatic image on photoconductive drum 60 corresponding to the electronic representation of the image generated by formatter 44.

Due to the rotation of photoconductive drum 60, the latent electrostatic image of photoconductive drum 60 interacts with print cartridge 64. Print cartridge 64 includes a developer roller 76 and a supply of toner 78 (shown in FIG. 4A). Toner 78 is routed through print cartridge 64 and onto developer roller 76, as will be further described below. Developer roller 76 contacts photoconductive drum 60 to electrostatically transfer toner 78 to photoconductive drum 60. As such, toner 78 electrostatically adheres to photoconductive drum 60 according to the amount of discharge on each area of photoconductive drum 60.

Photoconductive drum 60 rotates from developer roller 76 over print medium 52, which is fed from print media tray 50 between photoconductive drum 60 and transfer roller 66. Interaction with photoconductive drum 60 and transfer roller 66 imparts sufficient pressure to print medium 52 to transfer toner 78 from photoconductive drum 60 to print medium 52.

Upon transfer of toner 78 to print medium 52, toner 78 is not fixed or fused to print medium 52. Therefore, print medium 52 is routed through fuser 68 to permanently set or fuse toner 78 to print medium 52. Fuser 68 includes a fuser roller 80 and a pressure roller 82. Fuser roller 80 is heated and contacts a surface 84 of print medium 52 as pressure roller 82 contacts an opposite surface 86 of print medium 52. Joint application of heat and pressure to print medium 52 fuses or sets toner 78 to print medium 52, thereby, creating a stable, printed document that exits print engine 48.

Following interaction with print medium 52, photoconductive drum 60 rotates past cleaning blade 70 to clean excess toner 78 from photoconductive drum 60. Photoconductive drum 60 also rotates past discharge lamp 72 to fully discharge photoconductive drum 60. Discharged and cleaned areas of photoconductive drum 60 are reintroduced to charging roller 62, and the printing process is repeated.

Figure 4:
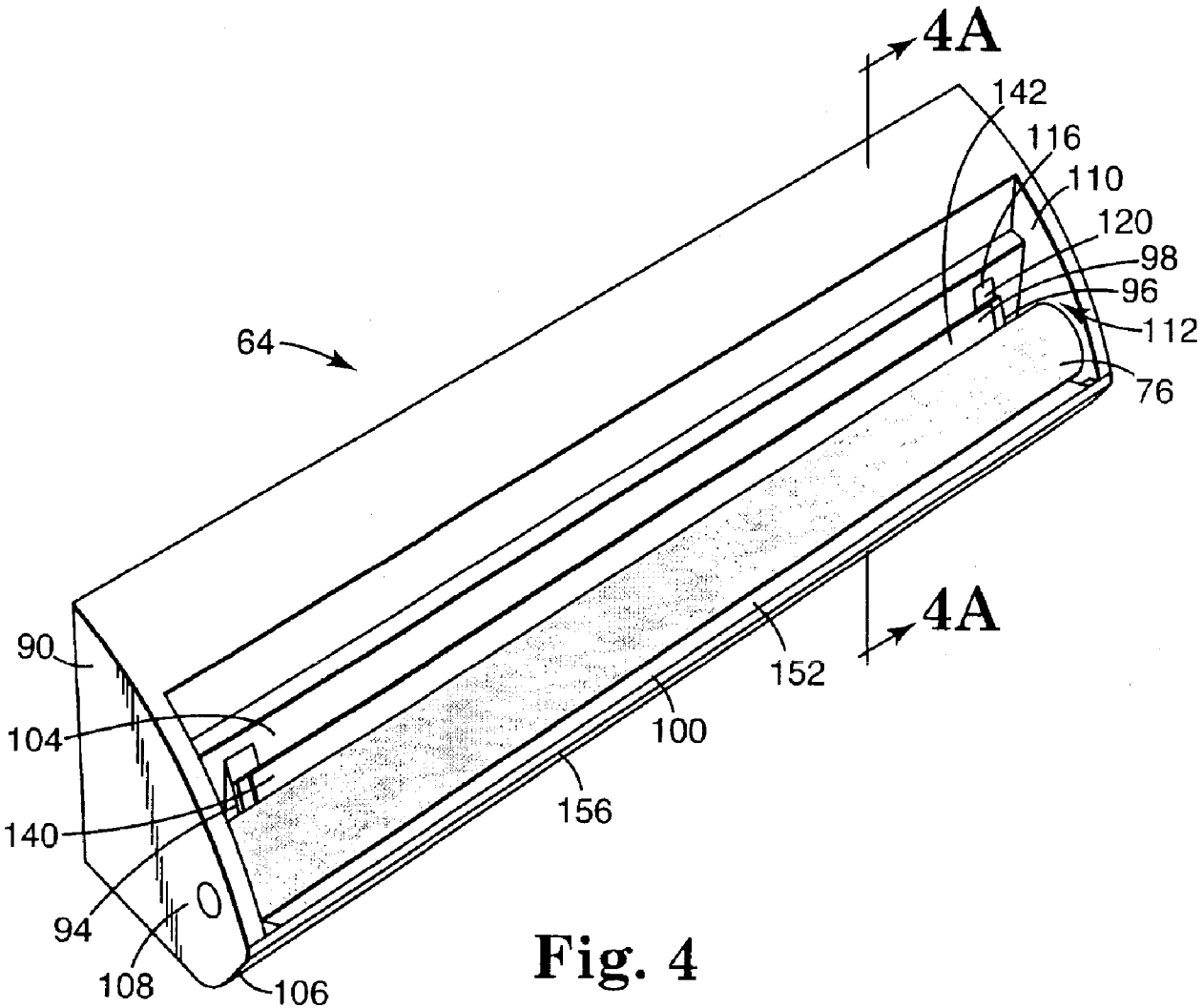
FIG. 4 is a perspective view illustrating a print cartridge for use with the printer illustrated in FIG. 3 according to one embodiment of the invention.
Figure 4A:
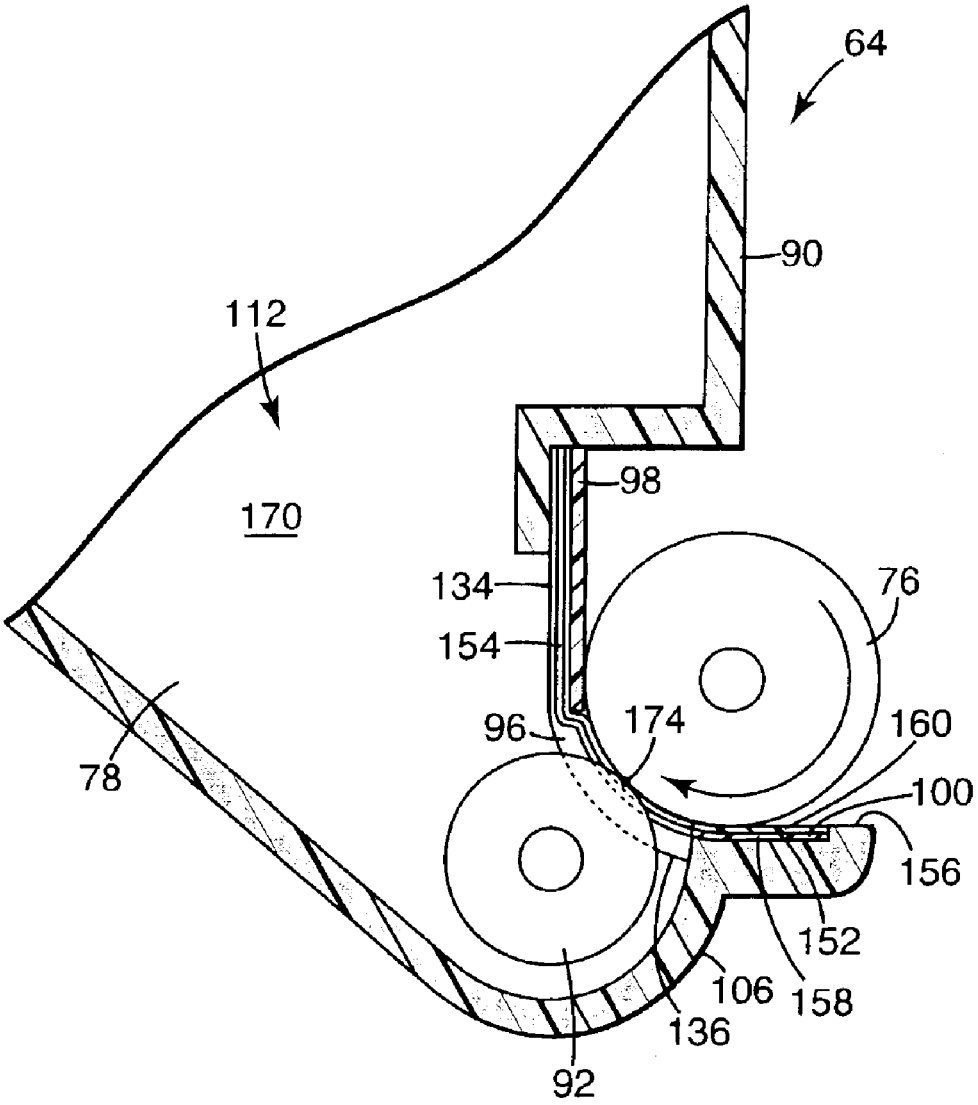
FIG. 4A is a cross-section of FIG. 4 taken along the line 4A—4A.
Figure 5:
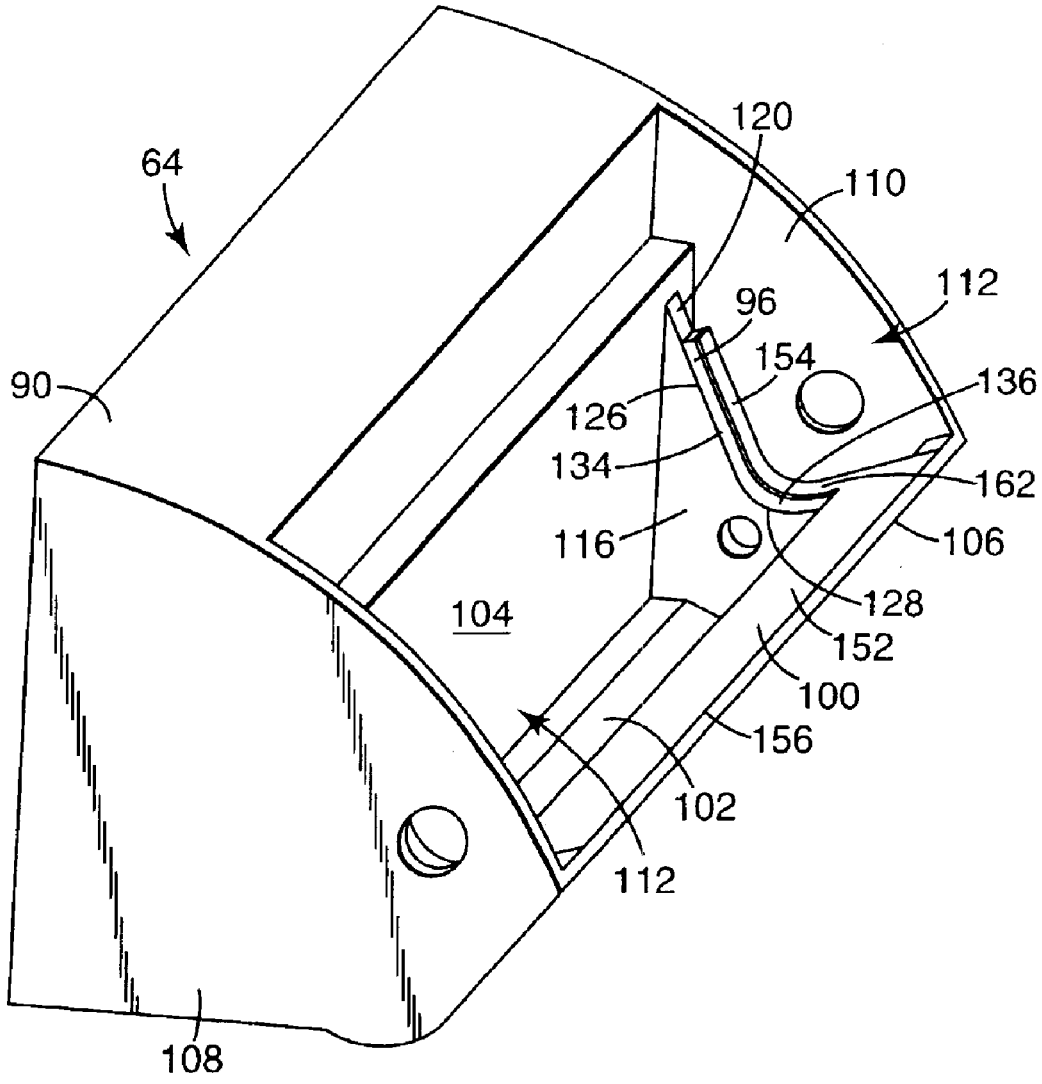
FIG. 5 is a perspective view illustrating a portion of a print cartridge illustrated in FIG. 4 according to one embodiment of the invention.

FIGS. 4, 4A, 5, and 6 collectively illustrate one embodiment of print cartridge 64. Print cartridge 64 includes a housing 90, a supply roller 92 (FIGS. 4A and 6), a first developer end seal or D-end seal 94, a second developer end seal or D-end seal 96, a doctor blade or D-blade 98, a C-shaped seal 100, and developer roller 76 (FIGS. 4 and 4A). As illustrated in FIG. 5, in which rollers 76, 92 are eliminated for clarity, housing 90 includes a bottom wall 102, a rear wall 104, a front wall 106, a first side wall 108, and a second side wall 110. Rear wall 104, front wall 106, first side wall 108, and second side wall 110 each extend in from bottom wall 102. In particular, front wall 106 is opposite rear wall 104 with respect to bottom wall 102. First side wall 108 extends between rear wall 104 and front wall 106. Second side wall 110 extends between rear wall 104 and front wall 106 and is opposite first side wall 108 with respect to bottom wall 102. As such, front wall 106, rear wall 104, first and second side walls 108 and 110, and bottom wall 102 define a cavity 112.

A first support 114 (shown in FIG. 6) and a second support 116 are each positioned within cavity 112 and each laterally extends from rear wall 104 to front wall 106. For clarity, developer roller 76 is not illustrated in FIG. 6. First support 114 is positioned near side wall 108. Support 116 is spaced from support 114 and is positioned near second side wall 110. Furthermore, supports 114 and 116 each extend from bottom wall 102 and terminate to form a top edge 118 (shown in FIG. 6) or a top edge 120, respectively. Top edge 118 has a linear section 122 and an arched section 124. Similarly, top edge 120 has a linear section 126 and an arched section 128. Each linear section 122 and 126 extends from rear wall 104 and is sized to facilitate attachment of D-blade 98. Each arched section 124 and 128 extends from front wall 106 and is sized to facilitate attachment of D-end seals 94 and 96. Supply roller 92 is rotatably mounted to and longitudinally extends between first support 114 and second support 116. In one embodiment, supply roller 92 is mounted such that an entirety of supply roller 92 is positioned within cavity 112 and below top edges 118 and 120 with respect to the orientation of FIGS. 4, 5, and 6.

Figure 6:
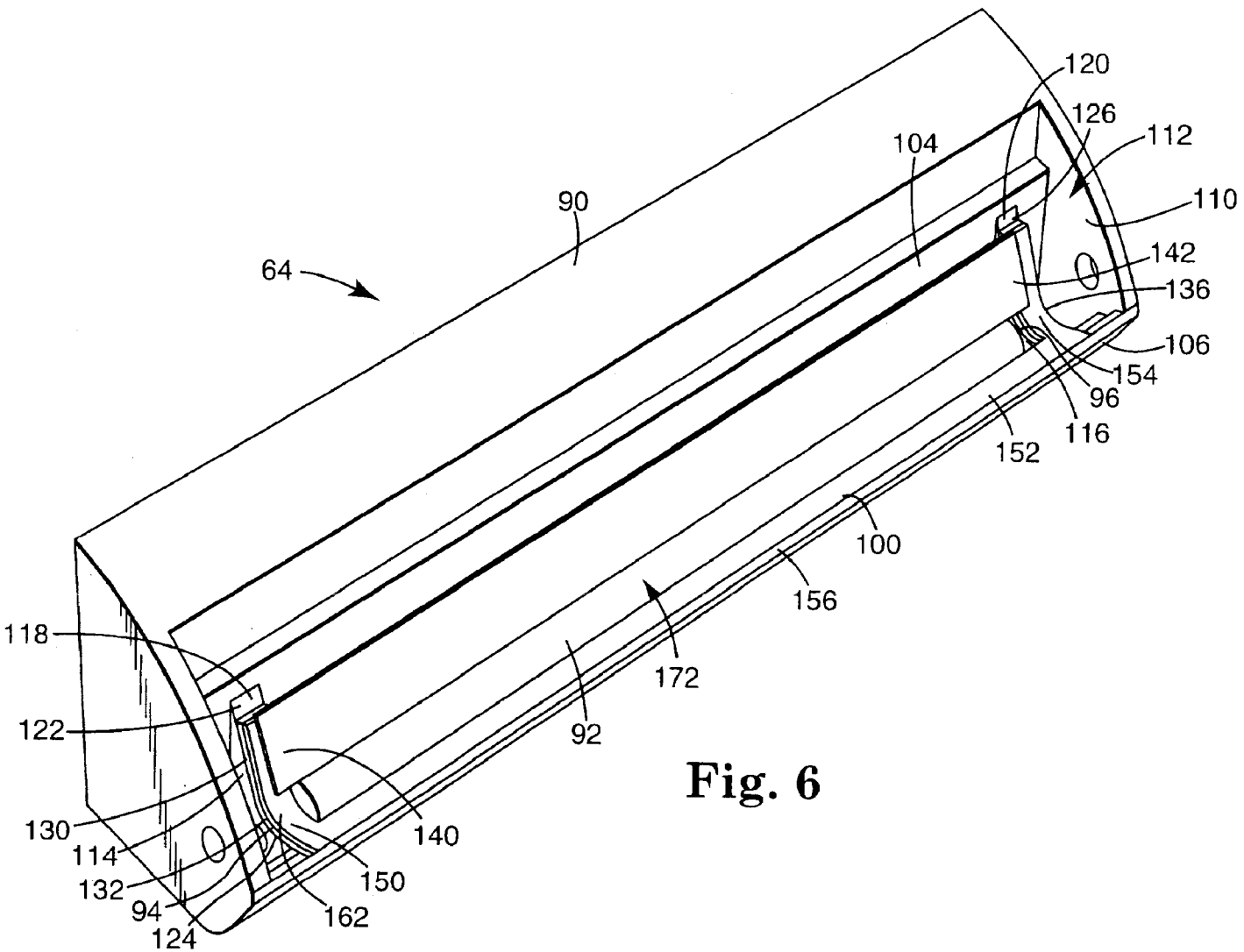
FIG. 6 is a perspective view illustrating a portion of the print cartridge illustrated in FIG. 4 according to one embodiment of the invention.

D-end seals 94 (shown in FIGS. 4 and 6) and 96 each extend from front wall 106 along top edge 118 and 120, respectively, toward rear wall 104. In particular, as illustrated in FIG. 6, first D-end seal 94 is connected to top edge 118 such that, upon connection, first D-end seal 94 defines a linear section 130 and an arched section 132 corresponding with linear section 122 and arched section 124 of top edge 118, respectively. Similarly, D-end seal 96 is attached to top edge 120 such that upon attachment D-end seal 96 defines a linear section 134 and an arched section 136 corresponding with linear section 126 and arched section 128 of top edge 120 respectively. Notably, each D-end seal 94 and 96 optionally is substantially linear prior to attachment to top edge 118 or 120. In one embodiment, D-end seals 94 and 96 are each adhered to respective top edge 118 or 120 by a double sided tape, a pressure sensitive adhesive (PSA), or a similar material. In one embodiment, first and second D-end seals 94 and 96 are made of a closed-cell foam material, capable of generally preventing toner leakage, such as Poron, although other materials with similar properties are contemplated.

C-shaped seal 100 extends over and between first D-end seal 94 and second D-end seal 96. In particular, C-shaped seal 100 has a first lateral section 150, a longitudinal section 152, and a second lateral section 154 arranged to form a substantially "C" shape. Lateral section 150 is sized to lay upon D-end seal 94 to form a seal capable of decreasing toner leakage between C-shaped seal 100 and D-end seal 94, i.e. in a first longitudinal direction. In one embodiment, lateral section 150 extends over linear section 130 and arched section 132 of D-end seal 94 towards longitudinal section 152.

Longitudinal section 152 extends from lateral section 150 and is sized to lay along a top portion 156 of front wall 106 to form a seal capable of decreasing toner leakage from print cartridge 64 along the top portion 156, i.e. in a lateral direction. In one embodiment, longitudinal section 152 is connected to top portion 156 by a double-sided tape, a PSA, or a similar material.

Lateral section 154 extends from longitudinal section 152 opposite lateral section 150 and lays upon D-end seal 96 to form a seal capable of decreasing toner leakage between C-shaped seal 100 and D-end seal 96, i.e. in a second longitudinal direction opposite the first longitudinal direction. In one embodiment, lateral section 154 is sized and shaped to extend from longitudinal section 152 over arched section 136 and linear section 134 of D-end seal 96. In one embodiment, each lateral section 150 and 154 is connected or secured to the respective D-end seal 94 or 96. Lateral sections 150 and 154 optionally are connected to D-end seal 94 and 96, respectively, by a double-sided tape, a PSA, or a similar material. In another embodiment, lateral sections 150 and 154 lay directly upon D-end seals 94 or 96, respectively, without any connection material or device. Notably, lateral sections 150 and 154 of C-shaped seal 100 fit snugly with D-end seals 94 and 96, respectively, to form a sufficient seal to decrease or generally prevent toner leakage in either a first or second longitudinal direction.

In one embodiment, C-shaped seal 100 defines a first layer 158 and a second layer 160. In one embodiment first layer 158 and second layer 160 are defined throughout first lateral section 150, longitudinal section 152, and second lateral section 154. First layer 158 is adapted to interact with D-end seals 94 and 96 and top portion 156 of front wall 106, as described above. As such, first layer 158 is adapted to act as a seal upon interaction with either D-end seal 94 or 96 or top portion 156. In one embodiment, first layer 158 includes a Mylar material. However, first layer 158 optionally includes other materials having similar properties.

Second layer 160 is adapted to allow developer roller 76 to freely roll or rotate while contacting C-shaped-seal 100. As such, second layer 160 comprises a low friction surface 162, which contacts developer roller 76 and has a sufficiently low friction that will not overly impede the rotation of developer roller 76. In one embodiment, second layer 160 includes a Teflon material. However, second layer 160 optionally includes other materials having similar properties. In one embodiment, first layer 158 is laminated to second layer 160, although other methods of connecting first layer 158 and second layer 160 are contemplated.

In one embodiment, D-blade 98 is an elongated piece of a substantially rigid material that extends longitudinally between first and second supports 114 and 116. More particularly, D-blade 98 defines a first end 140 and a second end 142. First end 140 is connected to a portion of lateral section 150 of C-shaped seal 100 that corresponds with linear section 130 of D-end seal 94. Second end 142 is connected to a portion of lateral section 154 of C-shaped seal that corresponds with linear section 134 of D-end seal 96. In one embodiment, D-blade 98 and, consequently, portions of lateral sections 150 and 154, are partially embedded into each D-end seal 94 and 96. In one embodiment, D-blade 98 is secured to C-shaped seal 100 by a double side tape, a PSA, or a similar material.

Interaction between D-blade 98 and C-shaped seal 100 defines a toner supply chamber 170 and a supply window 172. Toner supply chamber 170 (shown in FIG. 4A) comprises the area within cavity 112 below the D-blade and the C-shaped seal 100, with respect to the orientation of FIGS. 4, 5, and 6, between supports 114 and 116. As such, supply roller 92 is positioned within toner supply chamber 170. Toner supply chamber 170 contains supply of toner 78 (shown in FIG. 4A) for use in the printing process. Supply window 172 is an opening framed by D-blade 98 and C-shaped seal 100. Supply window 172 acts as the boundary between toner supply chamber 170 and a remaining area of cavity 112. Supply window 172 is sized such that a portion of supply roller 92 is accessed through supply window 172 and to generally prevent or decrease excess toner 78 from exiting toner supply chamber 170 by circumventing supply roller 92. In one embodiment, supply window 172 is positioned such that a portion of supply roller 92 is at a height within cavity 112 substantially similar to the lowest height of lateral sections 150 and 154 of C-shaped seal 100 within cavity 112.

Developer roller 76 extends between and is rotatably mounted to side wall 108 and side wall 110. Developer roller 76 extends over and partially rests upon lateral sections 150 and 154 of C-shaped seal 100, such that developer roller 76 optionally freely rotates upon lateral sections 150 and 154. Notably, positioning of developer roller 76 to rest partially upon lateral sections 150 and 154 of C-shaped seal 100 increases the effectiveness of the seal created between D-end seal 94 and lateral section 150 and between D-end seal 96 and lateral section 154. Notably, in one embodiment, D-end seals 94 and 96 are formed of a material sufficient to slightly bias C-shaped seal 100 against developer roller 76 to decrease or generally prevent toner leakage near the ends of developer roller 76. The position of developer roller 76 allows developer roller 76 to rotate about a longitudinal axis and to contact supply roller 92 at a line of interaction 174 (shown as a point running in and out of the page in FIG. 4A) through supply window 172. In addition, developer roller 76 contacts D-blade 98. In one embodiment, developer roller 76 is configured to rotate from an area facing away from print cartridge 64 and past the supply roller prior to rotating past D-blade 98.

During use, rotation is introduced to developer roller 76 via the interaction between developer roller 76 and photoconductive drum 60 (shown in FIG. 3). As developer roller 76 rotates, supply roller 92 rotates as also driven e.g. by the print engine. Because supply roller 92 is located within toner supply chamber 170, rotation of supply roller 92 causes supply roller 92 to become coated with toner 78. As supply roller 92 interacts with developer roller 76, supply roller 92 transfers toner 78 to developer roller 76 at line of interaction 174 through supply window 172. Developer roller 76 rotates from line of interaction 174 past D-blade 98, contacting D-blade 98 such that D-blade 98 directs excess toner 78 on developer roller 76 back into toner supply chamber 170. Developer roller 76 rotates from D-blade 98 to interact with photoconductive drum 60 to electrostatically transfer toner 78 to the discharged areas of photoconductive drum 60, as previously described. As such, C-shaped seal 100 is utilized in a method to decrease toner leakage in and from print cartridge 64 in at least the lateral and the longitudinal directions.

According to embodiments of the invention, second layer 160 of C-shaped seal 100 stops, as viewed e.g. in the cross-sectional view of FIG. 4A, below the lower edge of D-blade 98. First layer 158 also optionally stops there. The foam or other material of D-seal 96 then optionally is thicker behind D-blade 98, because lateral section 154 of seal 100 is partially or totally absent, and the underlying foam of D-seal 96 makes the seal. Sealing capability is enhanced in certain situations, according to these embodiments. The anti-friction properties of e.g. Teflon layer 160 against developer roller 76 are retained, whether or not layer 160 extends past D-blade 98.

The configuration and interaction of the D-end seals and the C-shaped seal of the print cartridge serve to decrease or generally prevent bi-directional toner leakage from the print cartridge. By decreasing or generally preventing toner leakage in and from the print cartridge, the assembly of the D-end seals and the C-shaped seal generally prevents toner from entering unwanted areas of the printer and decreasing print quality, or from adhering to a user or a user's clothing. The D-end seals and the C-shaped seal optionally are separate pieces, or optionally are together of one-piece construction.

Although specific embodiments have been illustrated and described herein for purposes of description, it will be appreciated by those of ordinary skill in the art that a wide variety of alternate and/or equivalent implementations optionally are substituted for the specific embodiments shown and described without departing from the scope of the present invention. Those with skill in the chemical, mechanical, electromechanical, electrical, and computer arts will readily appreciate that the present invention optionally is implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A print cartridge, comprising:

a housing;

a seal disposed within the housing, the seal comprising:

a longitudinal section having a first end and a second end;

a first lateral section connected to and extending from the first end of the longitudinal section; and a second lateral section connected to and extending from the second end of the longitudinal section;

a first end seal associated with the first lateral section to generally prevent toner leakage from the print cartridge in a first direction; and a second end seal associated with the second lateral section to generally prevent toner leakage from the print cartridge in a second direction opposite the first direction;

wherein the longitudinal section, the first lateral section, and the second lateral section are arranged to be generally continuous and to generally prevent toner leakage from the print cartridge.

2. The print cartridge of claim 1, wherein the longitudinal section, the first lateral section, and the second lateral section are formed as one piece.

3. The print cartridge of claim 1, wherein the longitudinal section is connected to the housing to generally prevent toner leakage from the print cartridge in a third direction.

4. The print cartridge of claim 1, further comprising a developer roller, wherein the longitudinal section, the first lateral section, and the second lateral section collectively define a first layer and a second layer, the second layer interacting with the developer roller.

5. The print cartridge of claim 4, wherein the first layer is laminated to the second layer.

6. The print cartridge of claim 4, wherein the first layer is adapted to form a seal with at least one of a first end seal, a second end seal, and the housing of the print cartridge to generally prevent toner leakage from the print cartridge.

7. The print cartridge of claim 4, wherein the second layer comprises a low-friction surface adapted to allow the developer roller to rotate while interacting with the second layer.

8. The print cartridge of claim 1, wherein the longitudinal section, the first lateral section, and the second lateral section are arranged to form a generally C-shaped seal.

9. A print cartridge, comprising:

a housing;

a first end seal coupled with the housing;

a second end seal coupled with the housing and spaced from the first end seal; and a generally C-shaped seal extending from the first end seal to the second end seal;

wherein the generally C-shaped seal, the first end seal, and the second end seal are adapted to generally prevent toner leakage from the print cartridge.

10. The print cartridge of claim 9, wherein the generally C-shaped seal is formed as one continuous piece and comprises:

a longitudinal section having a first end and a second end;

a first lateral section connected to and extending from the first end of the longitudinal section, and a second lateral section connected to and extending from the second end of the longitudinal section.

11. The print cartridge of claim 10, wherein the first lateral section of the generally C-shaped seal interacts with the first end seal to generally prevent toner leakage between the generally C-shaped seal and the first end seal.

12. The print cartridge of claim 11, wherein the second lateral section of the generally C-shaped seal interacts with the second end seal to generally prevent toner leakage between the generally C-shaped seal and the second end seal.

13. The print cartridge of claim 12, further comprising a developer roller, wherein the first lateral section and the second lateral section are adapted to interact with the developer roller, the first end seal is adapted to bias the first lateral section against the developer roller, and the second end seal is adapted to bias the second lateral section against the developer roller.

14. The print cartridge of claim 9, wherein the first end seal and the second end seal comprise foam.

15. The print cartridge of claim 14, wherein the first end seal and the second end seal comprise closed-cell foam material.

16. The print cartridge of claim 9, further comprising a developer roller, wherein the generally C-shaped seal defines a first layer and a second layer, the second layer being adapted to interact with the developer roller.

17. The print cartridge of claim 16, wherein the second layer is a low-friction layer adapted to allow the developer roller to rotate while interacting with the second layer.

18. A print cartridge, comprising:

a housing comprising a first support and a second support opposite the first support, wherein the housing defines a toner supply chamber containing a supply of toner;

a first end seal connected to the first support;

a second end seal connected to the second support;

a generally continuous seal extending between the first end seal and the second end seal in a longitudinal direction, the generally continuous seal also extending in the direction of the first end seal and the second end seal to cover the first end seal and the second end seal; and a roller extending over and rotatably contacting the generally continuous seal, the first end seal being disposed at one end of the roller and the second end seal being disposed at an end of the roller opposite the one end;

wherein the generally continuous seal, the first end seal, and the second end seal interact to generally prevent leakage of the supply of toner from the print cartridge.

19. The print cartridge of claim 18, wherein the generally continuous seal defines a general C shape and comprises:

a longitudinal section having a first end and a second end;

a first lateral section extending from the first end of the longitudinal section and interacting with the first end seal, and a second lateral section extending from the second end of the longitudinal section and interacting with the second end seal.

20. The print cartridge of claim 19, wherein the generally C-shaped seal defines a first layer and a second layer, the second layer interacting with the roller and the first layer interacting with the housing, the first end seal, and the second end seal.

21. The print cartridge of claim 20, wherein the first layer and the second layer are formed of different materials.

22. A method of decreasing toner leakage in and from a print cartridge including a developer roller rotatably mounted to a housing, the housing defining a toner supply chamber storing a toner, the method comprising:

routing toner from the toner supply chamber to the developer roller;

routing toner from the print cartridge to a photoconductive drum via the developer roller; and utilizing a generally C-shaped continuous seal to decrease multi-directional toner leakage from the print cartridge.

23. The method of claim 22, the method further comprising:

utilizing a first end seal to decrease toner leakage from the print cartridge in a first direction;

utilizing a second end seal to decrease toner leakage from the print cartridge in a second direction opposite the first direction; and covering both the first end seal and the second end seal with a generally continuous seal to decrease toner leakage from the print cartridge in a third direction.

24. A print cartridge, comprising:

means for sealing opposite ends of the print cartridge; and means for sealing both a front of the print cartridge and the opposite ends of the print cartridge, the front of the print cartridge extending between the opposite ends of the print cartridge;

wherein the means for sealing both the front and the opposite ends generally covers the means for sealing the opposite ends; further wherein the means for sealing both the front and the opposite ends extends generally parallel to the opposite ends and generally perpendicular to the opposite ends;

further wherein the means for sealing opposite ends, and the means for sealing both the front and the opposite ends, together generally prevent toner leakage in a first direction from the front of the print cartridge and in second and third directions from the opposite ends of the print cartridge, the second and third directions being generally opposite each other and being different than the first direction.

25. The print cartridge of claim 24, wherein the means for sealing both the front and the opposite ends defines a single generally C-shaped seal.

26. The print cartridge of claim 24, wherein the means for sealing both the front and the opposite ends comprises two layers, one of the two layers forming a seal with the means for sealing the opposite ends and the other of the two layers contacting a roller of the print cartridge and allowing rotation of the roller.

27. A print cartridge, comprising:

a housing; and a seal disposed within the housing, the seal comprising:

a longitudinal section having a first end and a second end;

a first lateral section connected to and extending from the first end of the longitudinal section; and a second lateral section connected to and extending from the second end of the longitudinal section;

wherein the longitudinal section, the first lateral section, and the second lateral section are arranged to be generally continuous and to generally prevent toner leakage from the print cartridge;

further wherein the longitudinal section, the first lateral section, and the second lateral section are arranged to form a generally C-shaped seal.

28. A print cartridge, comprising:

a housing comprising a first support and a second support opposite the first support, wherein the housing defines a toner supply chamber containing a supply of toner;

a first end seal connected to the first support;

a second end seal connected to the second support;

a generally continuous seal extending between the first end seal and the second end seal in a longitudinal direction, the generally continuous seal also extending in the direction of the first end seal and the second end seal to cover the first end seal and the second end seal; and a roller extending over and rotatably contacting the generally continuous seal;

wherein the generally continuous seal, the first end seal, and the second end seal interact to generally prevent leakage of the supply of toner from the print cartridge;

further wherein the generally continuous seal defines a general C shape and comprises:

a longitudinal section having a first end and a second end;

a first lateral section extending from the first end of the longitudinal section and interacting with the first end seal, and a second lateral section extending from the second end of the longitudinal section and interacting with the second end seal.

29. The print cartridge of claim 18, further wherein the generally continuous seal, the first end seal, and the second end seal interact to generally prevent leakage of the supply of toner from the print cartridge along generally the entire length of the roller and in two other, opposite directions at said ends of the roller.

* * * * *